United States Patent [19]

Fett

[11] Patent Number: 4,940,151

[45] Date of Patent: Jul. 10, 1990

[54] INFANT FLUID DRINKING CONTAINER

[76] Inventor: Michael E. Fett, P.O. Box 990, Little Elm, Tex. 75068

[21] Appl. No.: 383,524

[22] Filed: Jul. 24, 1989

[51] Int. Cl.[5] ..... A61J 9/00

[52] U.S. Cl. ..... 215/11.1; 215/100 A

[58] Field of Search ..... 215/11.1, 11.5, 100 A; D24/47

[56] References Cited

U.S. PATENT DOCUMENTS

| | | | |
|---|---|---|---|
| D. 49,225 | 6/1916 | Shultz | D24/47 |
| D. 167,273 | 7/1952 | Nusbaum | D24/47 |
| D. 212,921 | 12/1968 | Bloomberg | D24/47 |
| D. 244,776 | 6/1977 | Meeker | D24/47 |
| D. 251,612 | 4/1978 | Langergren et al. | D24/47 |
| D. 283,920 | 5/1986 | Chen | D24/47 |
| D. 288,127 | 2/1987 | Simmons | D24/47 |
| D. 288,128 | 2/1987 | White et al. | D24/47 |
| D. 288,362 | 2/1987 | Simmons | D24/47 |
| 1 707,799 | 4/1929 | Dugan | 222/572 X |
| 2,355,010 | 8/1944 | Pera | 222/572 X |
| 2,789,002 | 4/1957 | Nicholas | 215/11.1 X |
| 3,071,272 | 1/1963 | Doner | 215/11.1 |
| 3,134,495 | 5/1964 | Carbonel | 215/11.5 |
| 3,145,867 | 8/1964 | Roberts et al. | 215/11.1 |
| 3,990,596 | 11/1976 | Hoftman | 215/11.1 |
| 4,153,170 | 5/1979 | Aquarian | 215/11.1 |
| 4,557,392 | 12/1985 | Ryan et al. | 215/11.1 |
| 4,600,111 | 7/1986 | Brown | 215/11.1 X |
| 4,603,784 | 8/1986 | Chang | 215/11.1 |
| 4,676,387 | 6/1987 | Stephenson et al. | 215/11.1 |
| 4,793,533 | 12/1988 | Yang | 215/11.1 X |

FOREIGN PATENT DOCUMENTS

| | | | |
|---|---|---|---|
| 646 | of 1868 | United Kingdom | 215/11.1 |
| 222798 | 10/1924 | United Kingdom | 215/11.1 |

*Primary Examiner*—Sue A. Weaver

*Attorney, Agent, or Firm*—Andrew M. Hassell

[57] ABSTRACT

An infant fluid drinking/nursing container including a reservoir with a principal elongated section and a lesser elongated section whose axis is disposed less than 90 degrees with respect to the axis of the principal elongated section and having at the extremities of both reservoir sections, an opening through which fluid may be introduced and exited (dispensed). By thusly disposing the position and orientation of these openings, the container becomes especially versatile in use and maintenance. The container also is fitted with a pair of opposed curved handles that, in combination with the aforementioned pair of openings, renders the container particularly adaptable for use by an unaided infant.

7 Claims, 2 Drawing Sheets

INFANT FLUID DRINKING CONTAINER

This invention relates to infant fluid drinking containers and more particularly to such containers which are adapted for multipurpose use.

BACKGROUND OF THE INVENTION

A variety of infant fluid drinking containers have heretofore been proposed, illustrative of which are those disclosed in U.S. Pat. Nos. Des. 212,921 granted to Carl M. Bloomber on Dec. 10, 1968 and 288,127 granted to William Shannon on Feb. 3, 1987; and U.S. Pat. Nos. 3,145,867 granted to Edwin T. Roberts et al. on Aug. 25, 1964, 3,990,596 granted to Moshe Hoftman on Nov. 9, 1976, 4,557,392 granted to Kathryn A. Ryan et al. on Dec. 10, 1985, and 4,676,387 granted to Jim D. Stephenson et al. on June 30, 1987. As will be observed from reference to these patents, various proposals have been made to increase the usefulness and versatility of infant fluid drinking containers.

While some of the currently available infant fluid drinking containers perform effectively, it has been found that their usefulness is often proscribed by certain limitations. Thus, for example, some of them do not readily admit of use by the infant itself. Others are difficult to clean and sterilize, and others may be difficult or excessively costly to manufacture.

Accordingly, there has continued to be a need for a fluid feeding product that permits use by an infant without assistance while in both a vertical and horizontal attitude, is easy to clean, can be readily manufactured and is versatile in use.

BRIEF SUMMARY OF THE INVENTION

The improved infant fluid drinking/nursing container according to the principles of this invention, includes a reservoir with a principal elongated section and a lesser elongated section whose axis is disposed less than 90 degrees with respect to the axis of the principal elongated section and having at the extremities of both reservoir sections openings through which fluid may be introduced and exited (dispensed). One of these openings is disposed in coaxial alignment with the principal axis of the principal elongated section of the reservoir, while the other is disposed in a direction whose axis is that of the lesser elongated section. By thusly disposing the position and orientation of these openings, the object becomes especially versatile in use and maintenance. The container also is fitted with a pair of curved handles affixed to opposite sides of the principal section of the reservoir that, in combination with the positions of the aforementioned pair of openings, render the container particularly adaptable for use in drinking or nursing by an unaided infant.

OBJECTS AND FEATURES OF THE INVENTION

It is one general object of the invention to improve infant fluid drinking containers.

It is yet another object of this invention to increase versatility of use for such containers.

It is still another object of the invention to facilitate cleaning and maintenance of such containers.

It is still another object of the invention to especially adapt such containers for unaided use by an infant.

Accordingly, in accordance with one feature of the invention, an elongated reservoir is fitted at each of its principal ends with an opening adapted for introducing and exiting fluid, thus enhancing versatility of the product.

In accordance with another feature of the invention, the principal axes of the two openings are disposed at an acute angle with respect to each other, thus further contributing to versatility and unaided use by an infant.

In accordance with another feature of the invention, the provision of the two openings essentially at opposite ends of the reservoir simplify cleaning and maintenance of the container, thus rendering it more desirable for use.

In accordance with yet another feature of the invention, the aforementioned pair of opposed curved handles are fitted geometrically to the container reservoir such that, in combination with the aforementioned pair of openings, the container is particularly adaptable for use by an unaided infant with fluid being exited or dispensed through either of the aforementioned openings.

These and other objects and features of the invention will become apparent from the following detailed description, by way of a preferred example, with reference to the drawing.

DESCRIPTION OF A PREFERRED EMBODIMENT

Figure 1:
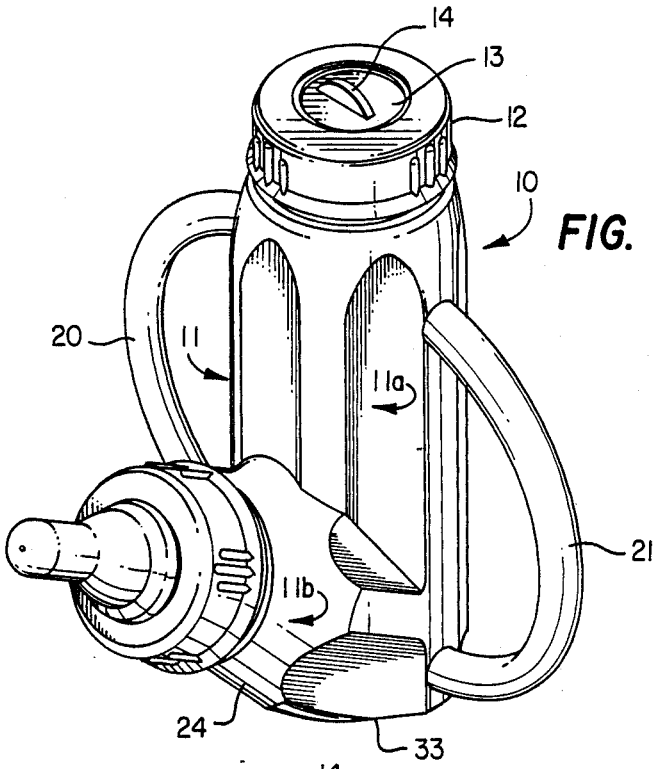
FIG. 1 is a perspective view depicting the improved infant fluid drinking (nursing) container in accordance with the principles of the invention.
Figure 2:
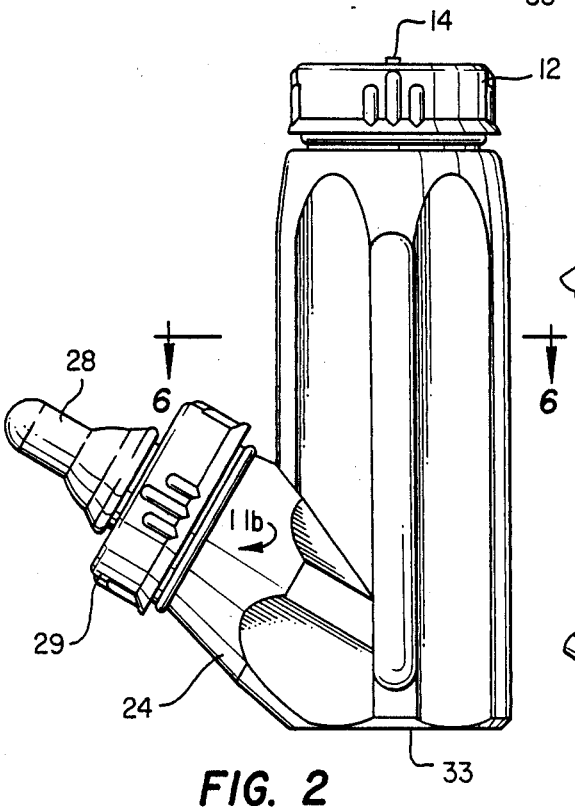
FIG. 2 is a side elevation view of the infant fluid drinking container.
Figure 5:
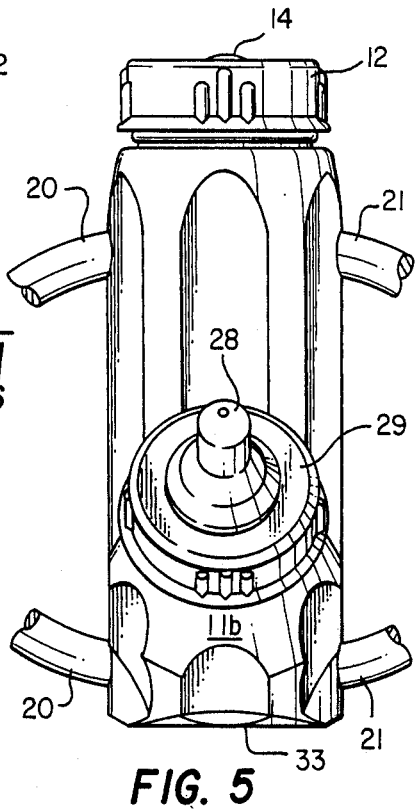
FIG. 5 is a front elevation view of the infant fluid drinking container.
Figure 3:
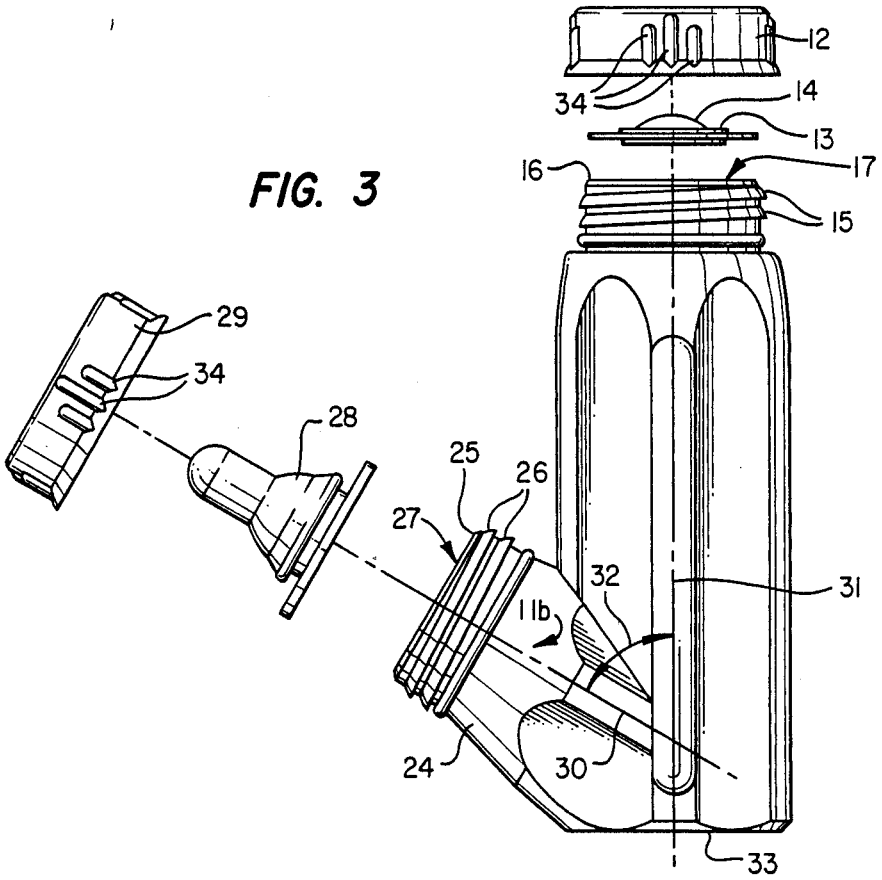
FIG. 3 is an exploded view of the container according to FIG. 2.
Figure 4:
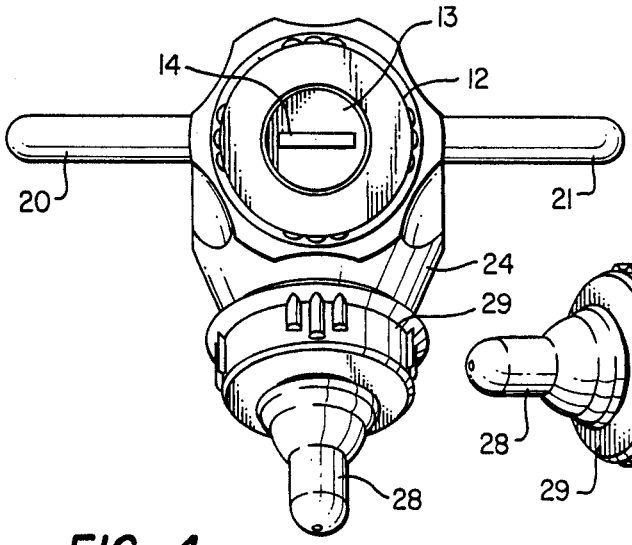
FIG. 4 is a top plan view of the infant fluid drinking container.

Now turning to the drawing, and more particularly FIG. 1 thereof, it will be observed that it depicts an improved infant fluid drinking (nursing) container in accordance with the principles of the invention. There, it will be observed, is shown a container 10 with a reservoir 11 having a principal elongated section 11*a* at the upper end of which there is and opening 17 (FIG. 3). Positioned on the upper end 16 there is a screw-on cap 12 within which there is an aperture-closing member 13 that is fitted with a handling projection 14. As will be observed from further reference to FIG. 3, screw-on cap 12 is fitted with female threads (not shown) that mate with corresponding male threads 15 so that when member 13 is positioned with cap 12 over upper end 16 of reservoir 11 and when the female threads within cap 12 are engaged with male threads 15 of reservoir 11, rotation of cap 12 fastens it securely to reservoir 11, thereby sealing upper circular aperture 17.

Reservoir 11 is generally hollow in order to provide containment for fluid such as milk, baby formula and the like. The walls 18 (FIG. 6) of reservoir 11 may be of any reasonable thickness that is sufficient to impart adequate structural strength to the container. In the preferred embodiment, the entire fluid drinking container assembly 10 is made of a material which is known in the trade by its initials P E T (Polyethylene Terephthalate) which has been found to be impact resistant and readily workable during manufacture, and the walls thereof have been of a nominal thickness of 30 thousandths of an inch. However, it should be apparent to those skilled in the art that a variety of other materials could be employed without departing from the spirit and scope of the invention.

Figure 6:
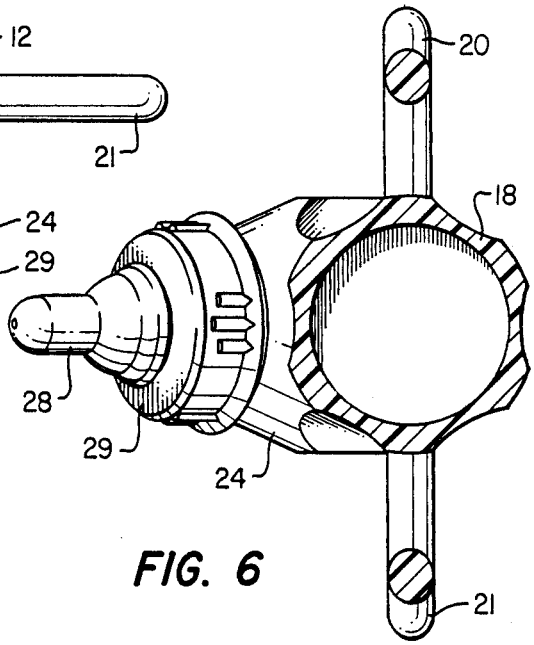
FIG. 6 is a section taken along section lines 6—6 of FIG. 2.

Further reference to the drawing and especially FIG. 6, reveals that the walls are not of uniform thickness. Although this feature is included in the preferred embodiment in order to provide enhanced handling and holding capability, the walls could be made cylindrical if desired. Moreover, although it is contemplated that the interior of the reservoir will be generally cylindrical or semi-cylindrical in cross section, other internal geometries could also be employed. Thus, the internal cross section could be elliptical or polygonal; and other geometrical shapes could be employed. Similar considerations apply to the exterior of the reservoir, although as mentioned above, in the preferred embodiment, the modified hexagonal shape that is shown has been found to provide advantages in handling and holding the container.

Positioned at opposite sides of the reservoir 11 and affixed thereto are holding handles 20 and 21. These handles preferably are circular in cross section and are curved as shown in order to avoid sharp turns or edges that might be difficult for an infant to handle or that might catch dirt, dried milk or the like and add to the difficulty of cleaning and maintenance.

At the lower extremity of the container 10 there is formed a lesser elongated reservoir section **11*b* which communicates internally with principal elongated reservoir section 11*a* and which forms an outwardly and upwardly tending projection 24. Although the cross section of projection 24 (i.e., lesser elongated reservoir section 11*b*) may be different in dimension than the corresponding cross section of main reservoir section 11*a***, for ease of manufacture, cleaning and other maintenance, it is preferred that it be similar or the same.

The extremity of projection 24 includes a threaded end 25 (FIG. 3) that is similar in configuration to upper end 16 of main reservoir section **11*a*. Thus, it includes male threads 26 and a generally circular aperture 27 that is adapted for mating with a conventional baby bottle nipple 28. Also included is conventional screw-on cap 29 which is similar to screw-on cap 12**.

It is important to the principles of the instant invention that the axis 30 of lesser elongated reservoir section **11*b* describe an acute angle 32 with respect to axis 31 of principal reservoir section 11*a*. The precise value of such angle 32** is not critical, but it has been found preferable for such value to fall within the range of from approximately 30 to 45 degrees. This facilitates manufacture of the container and enhances use of the container by an infant in either the erect or reclined position.

The particular geometries and interrelationships of the parts of the container render it especially attractive as an infant feeding/drinking/nursing apparatus. Thus, it will be observed that in a sense it is double-ended, thereby providing versatility in use. A nipple (or other conventional exiting or dispensing member) may be removably affixed to either of the openings 17 and 27, thereby making it possible for use in a variety of positions. Moreover, the provision of such plurality of openings facilitates manufacture. In addition, such plurality of openings facilitates cleaning and sterilization.

The positioning of the curved handles 20 and 21 in the positions indicated render them efficacious irrespective of which opening has been fitted with a fluid egress member (e.g., nipple or straw-like member) and irrespective of whether the container is being utilized by an infant in the reclining or erect position. Accordingly, through the cooperative interaction of the positioning of the parts, improved versatility is provided.

Although deemed self-evident from the drawing, it should be noted that the bottom 33 is a continuation of the walls 18 and consequently seals off reservoir 11 at the bottom thereof. In addition, the protrusions 34 (FIG. 3) on caps 12 and 29 are included to provide enhanced gripping for tightening and loosening.

It will now be evident that there has been described herein, an improved infant fluid drinking/nursing container. It should also be evident that the described container provides enhanced effectiveness while exhibiting improved operating characteristics; and that the container is simple in design and easy to clean and maintain, thus contributing to its attractiveness and desirability.

Although the invention hereof has been described by way of example of a preferred embodiment, it will be evident that other adaptations and modifications may be employed without departing from the spirit and scope thereof.

The terms and expressions employed herein have been used as terms of description and not of limitation; and thus, there is no intent of excluding equivalents, but on the contrary it is intended to include any and all equivalents that may be employed without departing from the spirit and scope of the invention.

What is claimed is:

1. An infant fluid drinking/nursing container including a reservoir with a principal elongated section having a first principal axis and a lesser elongated section having a second principal axis, said second principal axis being disposed at an angle less than 90 degrees with respect to said first principal axis, a first opening in said principal elongated section at the outer extremity thereof, a second opening in said lesser elongated section at the outer extremity thereof, means at each of said openings adapted for attaching a feeding element thereto, and means including a pair of handles attached to said principal elongated section for holding said container while fluid is being consumed therefrom.

2. An infant fluid drinking/nursing container according to claim 1 wherein said means at each of said openings adapted for attaching a feeding element thereto are further adapted for optionally attaching a sealing element thereto.

3. An infant fluid drinking/nursing container according to claim 1 wherein said feeding element is a nipple.

4. An infant fluid drinking/nursing container according to claim 2 wherein said feeding element is a nipple.

5. An infant fluid drinking/nursing container according to claim 1 in which said principal elongated section is attached to said lesser elongated section at the inner extremities thereof.

6. An infant fluid drinking/nursing container according to claim 5 in which said principal elongated section and said lesser elongated section are internally in direct fluid communication.

7. An infant fluid drinking/nursing container including:

(a) a reservoir with a principal elongated section having a first principal axis, an outer extremity and an inner extremity; and a lesser elongated section having a second principal axis, an outer extremity and an inner extremity; said second principal axis being disposed at an angle less than 90 degrees with respect to said first principal axis;

(b) a first opening in said principal elongated section at said outer extremity thereof, a second opening in said lesser elongated section at said outer extremity thereof;

(c) a third opening in said principal elongated section adjacent said inner extremity of said principal elongated section;

(d) a fourth opening in said lesser elongated section adjacent said inner extremity of said lesser elongated section;

(e) means adjoining said principal elongated section and said lesser elongated section at said inner extremities thereof whereby said third opening and said fourth opening are in internal registration to provide fluid communication between the interior of said principal elongated section and said lesser elongated section;

(f) means at each of said first and second openings adapted for attaching a feeding element thereto; and (g) means including a pair of handles attached to said principal elongated section for holding said container while fluid is being introduced to or consumed therefrom.

* * * * *